US006155527A

United States Patent [19]

Muyskens

[11] Patent Number: 6,155,527

[45] Date of Patent: Dec. 5, 2000

[54] APPLIANCE BASE PAD

[75] Inventor: David B. Muyskens, Hendersonville, Tenn.

[73] Assignee: Sonoco Development, Inc., Hartsville, N.C.

[21] Appl. No.: 08/931,407

[22] Filed: Sep. 16, 1997

[51] Int. Cl.[7] ..... B65D 19/34

[52] U.S. Cl. ..... 248/346.03; 248/346.01; 248/544; 108/51.3

[58] Field of Search ..... 248/346.03, 678, 248/544, 346.01; 108/51.3, 901

[56] References Cited

U.S. PATENT DOCUMENTS

| | | | |
|---|---|---|---|
| 3,591,121 | 7/1971 | Parris | 248/346 |
| 3,648,959 | 3/1972 | Wagner | 248/346 |
| 3,659,534 | 5/1972 | Childs | 108/56 |
| 3,891,170 | 6/1975 | Bricker et al. | 248/119 |
| 3,907,241 | 9/1975 | Oglesby et al. | 248/346 |
| 3,934,805 | 1/1976 | Elaschuk | 248/346 |
| 4,015,710 | 4/1977 | Biggs | 206/386 |
| 4,140,295 | 2/1979 | Daley | 248/346 |
| 4,146,205 | 3/1979 | Skinner | 248/346 |
| 4,183,491 | 1/1980 | Sanders et al. | 248/346 |
| 4,189,125 | 2/1980 | Little | 248/346 |
| 4,241,892 | 12/1980 | Morris | 248/346 |
| 4,390,154 | 6/1983 | Ostler et al. | 248/346 |
| 4,397,246 | 8/1983 | Ishida et al. | 108/55.3 |
| 4,399,972 | 8/1983 | McCulloch | 248/346 |
| 4,467,004 | 8/1984 | Liebel | 428/81 |
| 4,482,054 | 11/1984 | Gardner | 206/594 |
| 4,483,444 | 11/1984 | Gardner | 206/594 |
| 4,610,355 | 9/1986 | Maurer | 206/386 |
| 4,863,024 | 9/1989 | Booth | 206/386 |
| 4,869,456 | 9/1989 | Jacobs | 248/678 |
| 5,180,134 | 1/1993 | Mallak | 248/544 |
| 5,216,913 | 6/1993 | Winebarger et al. | 108/51.3 |
| 5,267,651 | 12/1993 | Hughes | 206/586 |
| 5,285,731 | 2/1994 | McIntyre | 108/51.3 |
| 5,308,037 | 5/1994 | Gonzalez | 248/670 |
| 5,385,238 | 1/1995 | Lancaster et al. | 206/594 |
| 5,593,039 | 1/1997 | Ortlieb | 206/586 |

FOREIGN PATENT DOCUMENTS

| | | |
|---|---|---|
| 366336 | 4/1982 | Austria . |
| 781698 | 8/1957 | United Kingdom . |
| 8202698 | 8/1982 | WIPO . |

*Primary Examiner*—Anita M. King
*Assistant Examiner*—Kimberly Wood
*Attorney, Agent, or Firm*—Bullwinkel Partners, Ltd.

[57] ABSTRACT

A base pad for supporting an appliance during assembly and shipping is provided. The pad has a pair of endpieces, each having portions for supporting the weight of an appliance, a pair of crosspieces connected to the endpieces to form a substantially rectangular base, and wrapping substantially covering the weight supporting portions of the endpieces. In addition to providing strength, the wrapping may also help hold the crosspieces and endpieces together. The endpieces are formed of a low density material, such as expanded polystyrene and the wrapping is formed of a medium to high density material such as kraft paper. The combination of the crosspieces formed of a low density material and the medium to high density wrapping material provides an optimum combination of strength and cushioning.

28 Claims, 3 Drawing Sheets

APPLIANCE BASE PAD

BACKGROUND

1. Field of the Invention

This patent relates to base pads for supporting products such as large appliances and the like. More specifically, this patent relates to a base pad having sufficient strength and cushioning such that it may be used during product assembly as well as during storage and shipping.

2. Description of the Related Art

Base pads, sometimes referred to as carriers, skids or pallets, are used to support and cushion large appliances (such as washers, dryers, refrigerators, dishwashers and stoves) during assembly, storage and transport. Conventional assembly pallets are usually made of wood to withstand the rigors of the assembly line. However, wood pallets by themselves are usually not. Used for shipping because they lack adequate cushioning to protect the appliance.

This problem can be mitigated by placing a ½ inch thick fabric mat between the wood base and the appliance. Alternatively, the appliance may be transferred onto a specialized shipping pad for transporting. Both of these solutions involve additional unwanted expense and extra steps during appliance assembly and shipping.

Base pads made from other materials have been tried with varying degrees of success. For example, base pads made of hard plastic, like wood pallets, provide adequate support but less-than-adequate cushioning. Conversely, base pads made of foam or layers of corrugated paperboard may provide adequate cushioning but do not provide sufficient strength to withstand the forces to which the pads are frequently subjected, particularly during the assembly phase.

To fill this need for a base pad having both strength and cushioning, a novel base pad made of multiple pieces of varying densities and a novel means to assemble the same have been developed. The base pad comprises a low density material such as a resin-based foam, an expanded paper-based material, honeycomb material or molded paper pulp material held within a confined space by a medium to high density wrapping material such as paper or paperboard to provide a strong, rigid structure having an optimum combination of strength and cushioning.

Thus, it is an object of the present invention to provide an appliance base pad that provides the support of a wood pallet but with better cushioning.

A further object of the present invention is to provide a base pad that can be used during assembly, storage and shipping of large appliances or other products.

A still further object of the present invention is to provide an appliance base pad that provides an optimum combination of strength and cushioning.

Another object of the present invention to provide a base pad that does not crack, warp, dry out or shrink during use.

Further and additional objects will appear from the description, accompanying drawings, and appended claims.

SUMMARY OF THE INVENTION

The present invention is a base pad for supporting an appliance during assembly and shipping comprising a pair of endpieces having portions for supporting the weight of the appliance, two crosspieces connected to the endpieces to form a substantially rectangular base, and wrapping substantially covering at least the weight supporting portions of the endpieces. In addition to providing strength, the wrapping may also help hold the crosspieces and endpieces together.

Preferably, the endpieces are formed of a low density material, the wrapping is formed of a medium to high density material, and the crosspieces are formed of a medium to high density material. For example, the endpieces may be formed of resin-based foams such as expanded polystyrene, polyethylene or urethane; expanded paper-based materials such as cellulose-based foam or paper-based foam; honeycomb material; molded paper pulp materials; cork, bubble wrap; or fibre. The wrapping may be formed of medium to high density materials such as paper, paperboard, plastic wrap, or chipboard. The crosspieces may be formed of medium to high density materials such as paper, paperboard, mixtures of paper and paperboard, and corrugated board.

Single or multiple layers of wrapping may be used. The wrapping may enclose some or part of the endpieces and some or part of the crosspieces.

The combination of the endpieces formed of a low density material and crosspieces formed of medium to high density material wrapped in medium to high density wrapping material provides an optimum combination of strength and cushioning.

THE DRAWINGS

DETAILED DESCRIPTION OF THE INVENTION

Figure 1:
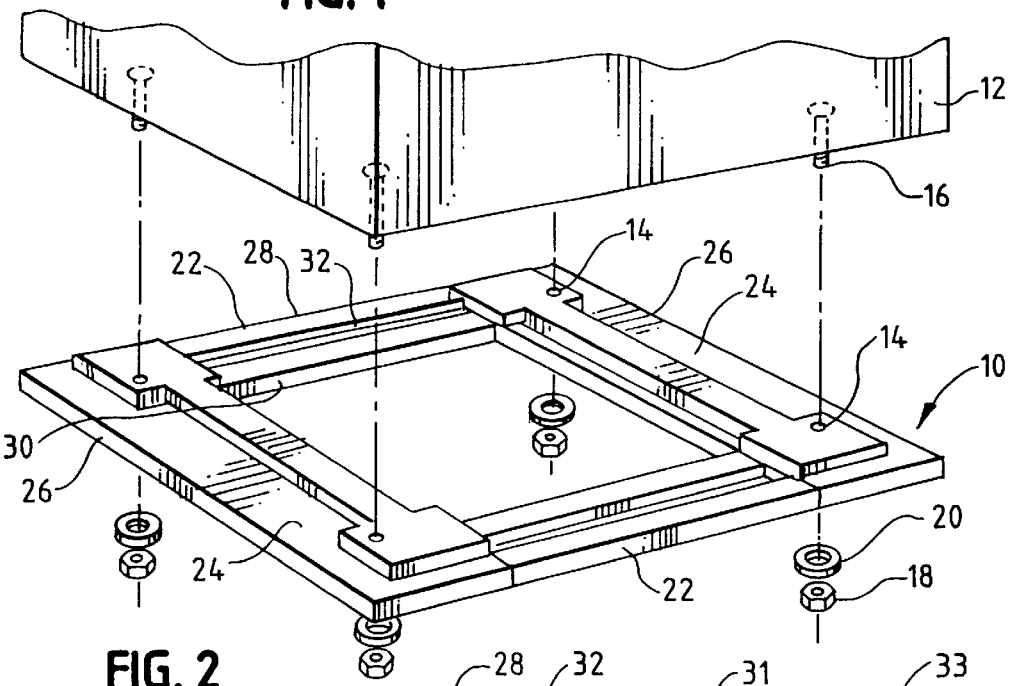
FIG. 1 is a view of the preferred embodiment of the present invention as it might be secured to an appliance.
Figure 2:
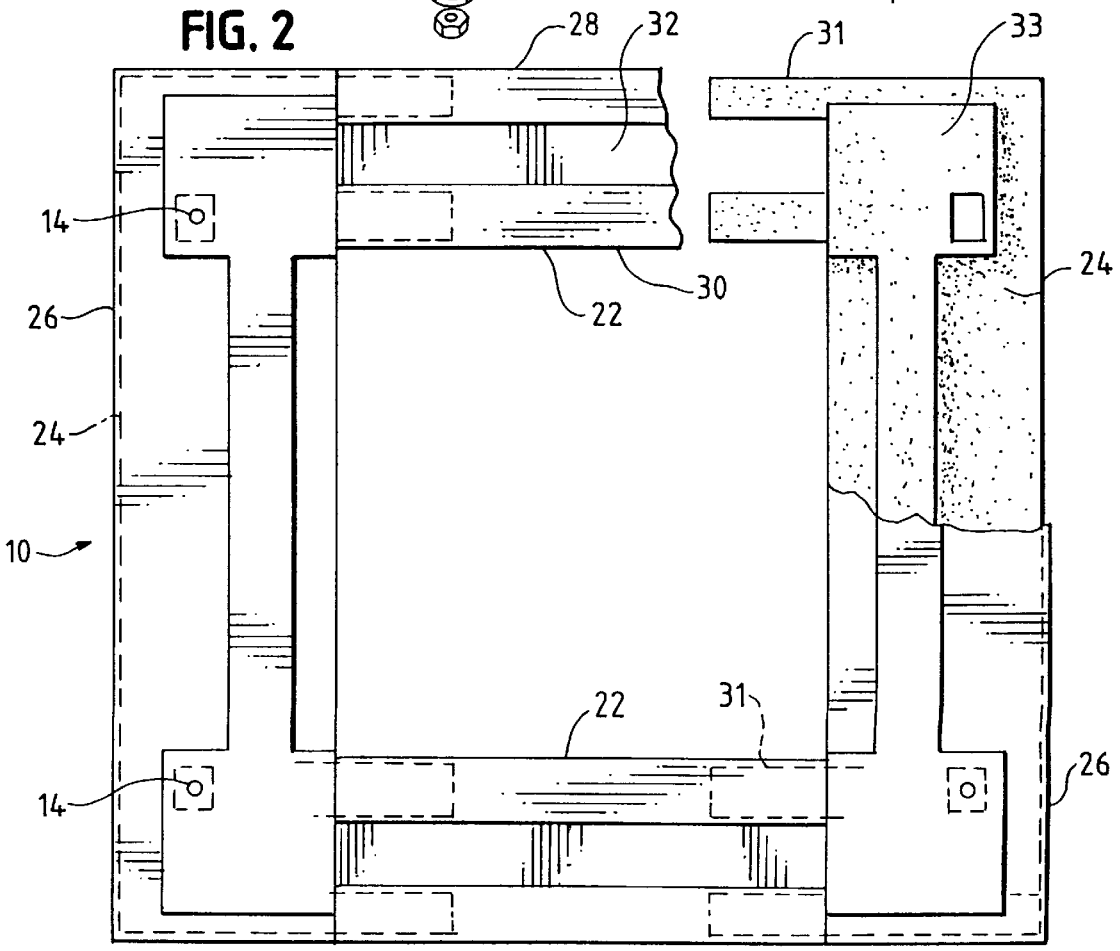
FIG. 2 is top plan view of the base pad of FIG. 1, shown in partial cutaway.
Figure 3:
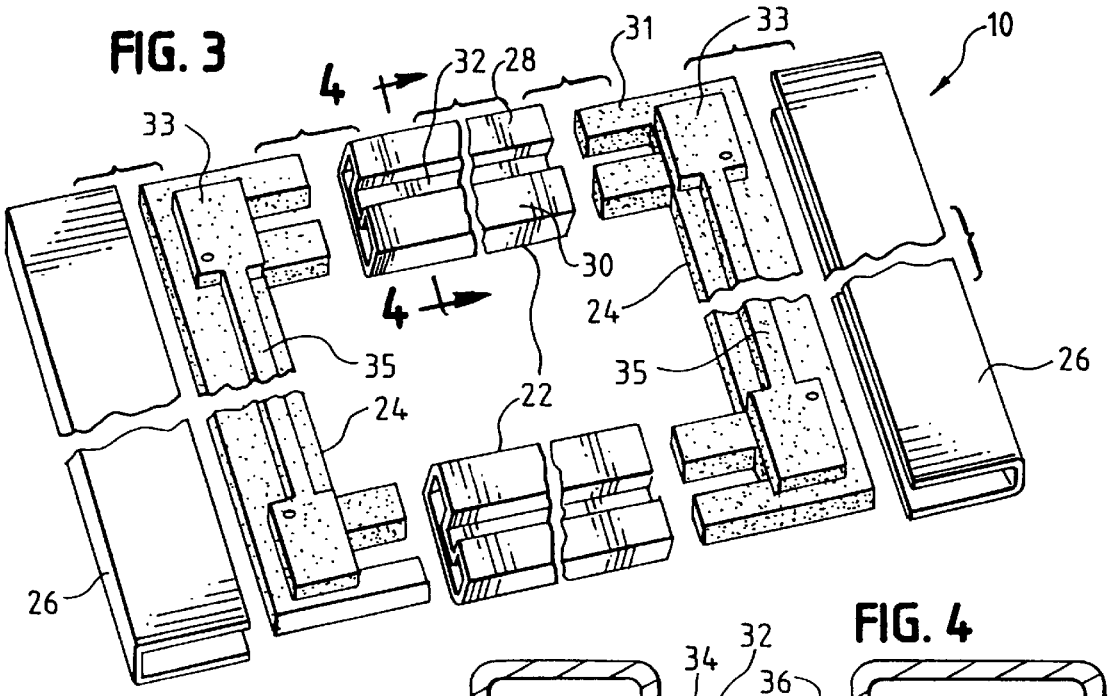
FIG. 3 is an exploded perspective view of the base pad of FIG. 1.

Turning to the drawings, there is shown in FIGS. 1–3 one embodiment of the base pad 10 according to the present invention, used to support an appliance 12 or other like product. Optional holes 14 drilled through the base pad 10 may accommodate bolts 16 extending from the bottom of the appliance 12. Nuts 18 and washers 20 or a threaded appliance "foot" (not shown) may be provided to receive the bolts 16.

In the preferred embodiment shown in FIGS. 2 and 3, the base pad 10 comprises three main components: a pair of crosspieces 22 formed of a medium to high density material such as layers of solid paper fiber laminated together; a pair of endpieces 24, preferably made from a low density material such as expanded polystyrene foam; and wrapping 26 made from a medium to high density material such as kraft paper. The endpieces 24 and a portion of the crosspieces 22 are wrapped tightly with multiple layers of glued wrapping 26 which conforms to the shape of the endpieces 24 and crosspieces 22. Significantly, the wrapping 26 substantially encapsulates the low density endpieces 24, thereby minimizing any movement or deformation of the endpieces 24 that might otherwise occur when weight bears down on the base pad 10. The combination of the low density endpieces 24 and the medium to high density crosspieces 22 wrapped in higher density wrapping material 26 provides an optimum combination of strength and cushioning.

Figure 4:
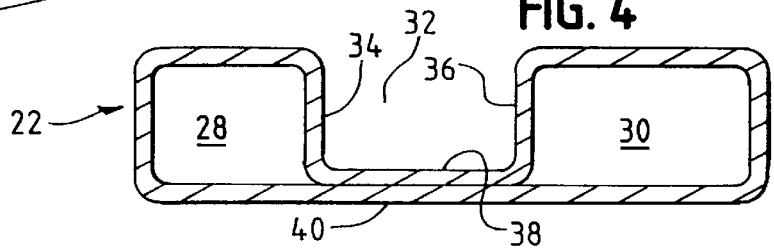
FIG. 4 is a cross sectional view of one of the crosspieces of the base pad of FIG. 3, taken along line 4—4.

FIG. 4 is a cross-sectional view of the one of the crosspieces 22 of the preferred embodiment. Each crosspiece 22 comprises a first tubular section 28 and a second tubular section 30. The tubular sections 28, 30 improve beam strength and top load or crush strength. The tubular sections 28, 30 may be substantially rectangular in cross section as they are FIG. 4 or any other suitable shape. The tubular sections 28, 30 define a downwardly opening channel or groove 32 that runs substantially the length of the crosspiece 22. The groove 32 has opposing walls 34, 36 and a bottom wall 38 adjacent the bottom surface 40 of the crosspiece 22.

In the preferred embodiment the groove opposing walls 34, 36 are parallel to each other, but this need not: be the case. Inasmuch as the primary functions of the crosspieces 22 are to connect the endpieces 24 together and to provide beam and top load strength, any crosspiece configuration that performs these functions will do. For example, in one anticipated configuration, one groove opposing wall and the groove bottom wall 40 define an acute angle.

Preferably, the crosspieces 22 are made of medium to high density material. In the preferred embodiment the crosspieces 22 are formed of multiple layers of 26# kraft paper laminated together in a sufficient number of layers to provide needed beam and top load strength. Other crosspiece materials are contemplated, such as convolutely wound paperboard, recycled paper, treated paper, mixtures of paper and paperboard, and corrugated board.

Figure 5:
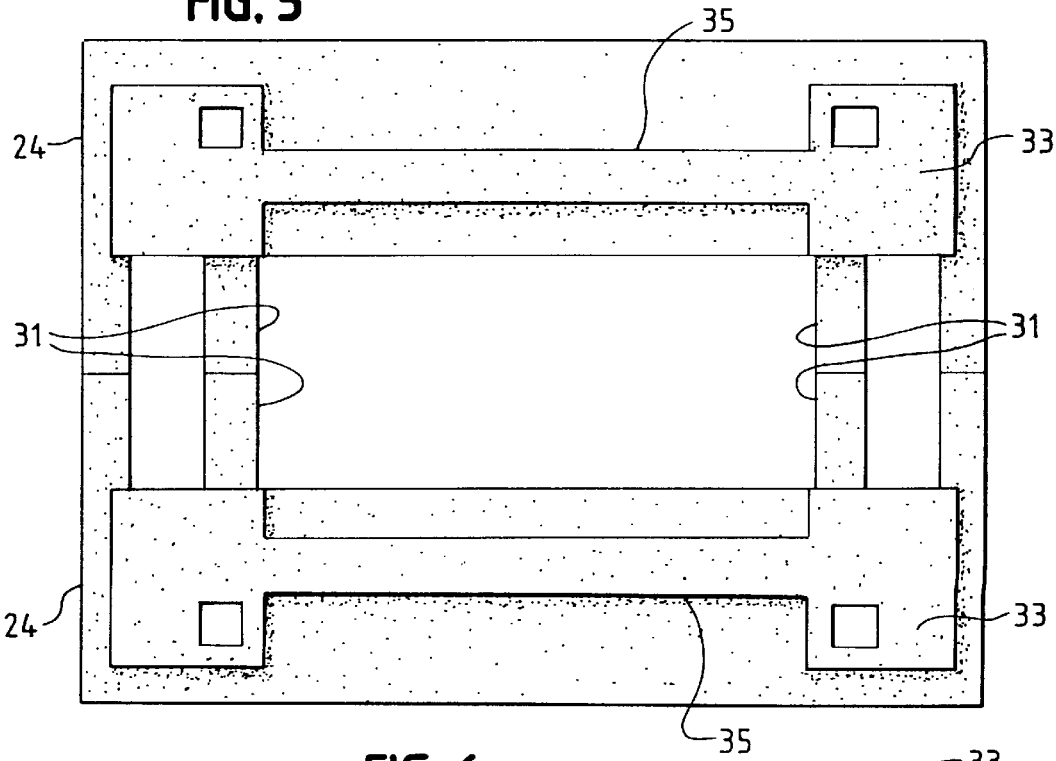
FIG. 5 is a top plan view of the endpieces of the base pad of FIG. 1.
Figure 6:
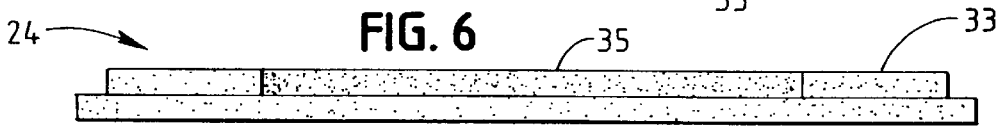
FIG. 6 is a side elevational view of one of the endpieces of the base pad of FIG. 1.

The endpieces 24 can be made in any number of shapes depending on the application. In the embodiment depicted in FIGS. 5 and 6, the endpieces have integrally formed raised platforms 33 at either end for additional thickness at the load bearing areas, connected by a raised runner 35 for added stability. In the preferred embodiment shown in FIGS. 2 and 3, the endpieces 24 have toes or projections 31 configured to fit snugly inside the crosspiece tubular sections 28, 30 to form an overall square or rectangular shaped pad.

The endpieces 24 preferably are made of a low density material to provide a lightweight cushion for the appliance. Examples of low density materials include resin based foams such as expanded polystyrene, polyethylene foam and urethane foam; expanded paper-based materials such as cellulose based foams and paper pulp based foams; honeycomb material; molded paper pulp materials; cork; bubble wrap; and recycled paper fibre.

In the preferred embodiment, a medium to high density wrapping material encloses part or all of the top and bottom of the endpieces 24 and part of the crosspieces 22, holding the entire structure together. Wrapping the endpieces 24 and crosspieces 22 in a medium to high density material results in a structure having greater strength than could otherwise be provided by a low density material without wrapping.

Suitable medium to high density materials for use as wrapping include heavy paper such as kraft paper, paperboard, plastic wrap such as polypropylene, and chipboard. In the preferred embodiment, two layers of 26# kraft paper are used as wrapping. A single layer of heavier weight kraft paper may also be used.

It may be desirable for environmental reasons to match the materials of construction of the endpieces, crosspieces and wrapping. For example, it may be desirable to use all paper-based materials or all plastic-based materials to enhance recyclability.

During use, the appliance 12 rests on the wrapped endpieces 24, which typically run front to back with respect to the appliance 12. The appliance 12 may be bolted to the pad 10, as shown in FIG. 1.

The combination of a low density material wrapped by a high density material results in a shipping pad that is strong enough to withstand the rigors of large appliance assembly line production, yet has sufficient cushioning to protect the appliance from damage due to jarring during shipping. The invention as described herein has passed a major appliance manufacturer's test for ranges, employing the toughest testing protocol in the industry.

Figure 7:
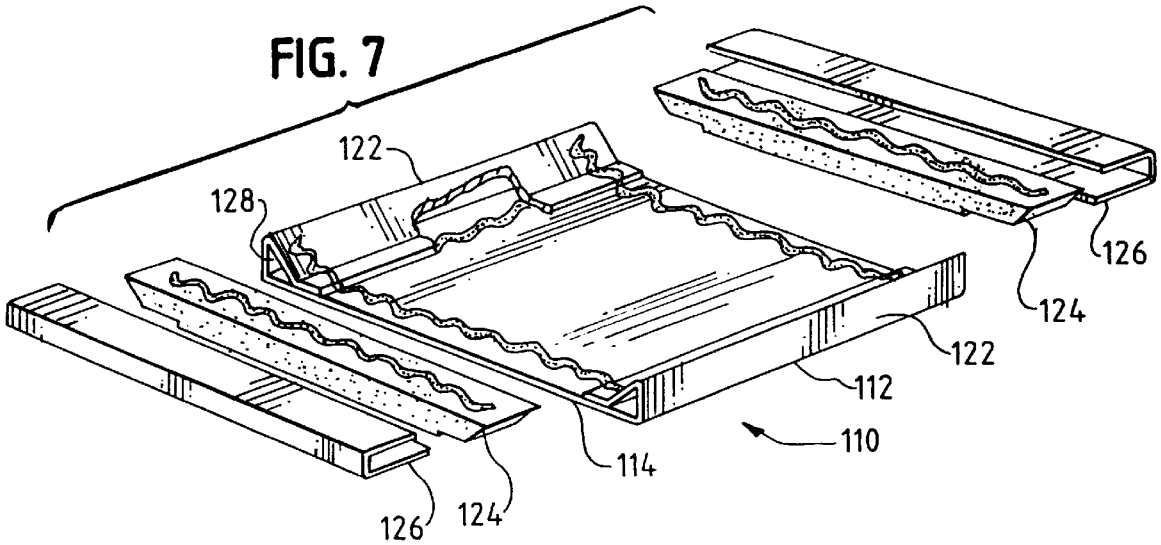
FIG. 7 is an exploded perspective view of a second embodiment of the present invention.
Figure 8:
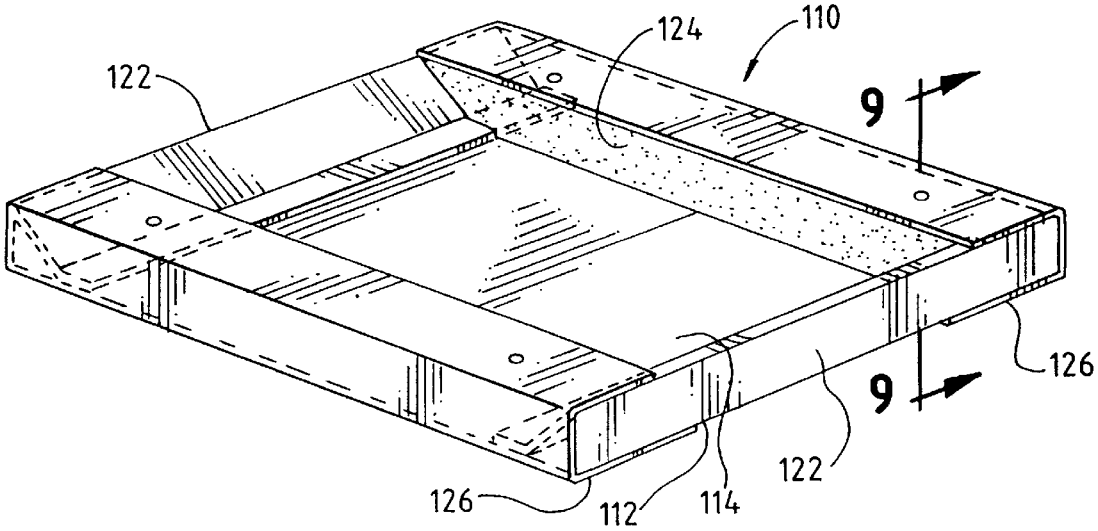
FIG. 8 is a perspective view of the second embodiment.
Figure 9:
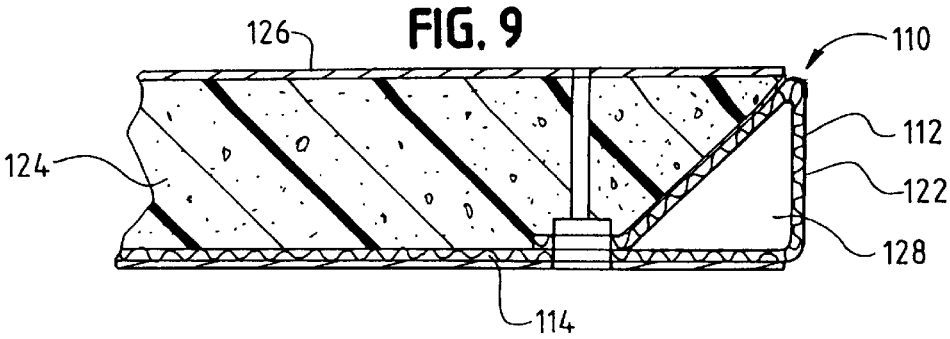
FIG. 9 is a cross sectional view of the second embodiment, taken along line 9—9 of FIG. 8.

In one alternative embodiment shown in FIGS. 7–9, a base pad 110 is provided having a central piece 112, endpieces 124 and wrapping 126. The central piece comprises a single sheet of material scored, folded and glued on either side to form crosspieces 122 and a bottom sheet 114 interposed therebetween. The crosspieces 122 may define substantially triangular tubular sections 128, as best shown in FIG. 9.

The endpieces 124 are configured to fit snugly at either end of the central piece 112, and may be glued thereto. The wrapping 126 encapsulates the endpieces 124 and a portion of the central piece 112 to form a strong but cushioned base pad 110. As in the preferred embodiment, the endpieces 124 may be formed of low density material such as expanded polystyrene foam. The central piece 112 may be formed of medium to high density material such as corrugated board. The wrapping 126 may be formed of medium to high density material such as kraft paper.

In a third embodiment (not shown), a single crosspiece connects two endpieces to form an H- or U-shaped base pad, depending on the point of attachment. In yet another embodiment (not shown), a single crosspiece is attached to a single endpiece to form a T- or L-shaped base pad, depending on the point of attachment.

Other modifications and alternative embodiments of the invention are contemplated which do not depart from the spirit and scope of the invention as defined by the foregoing teachings and appended claims. It is intended that the claims cover all such modifications that fall within their scope.

I claim as my invention:

1. A base pad for supporting a product comprising:

at least one endpiece having portions for supporting the weight of the product;

at least one crosspiece connected to the at least one endpiece; and pliable covering pressed into place around the endpiece such that the covering deforms to the shape of the endpiece to minimize any deformation of the endpiece when supporting the product, said covering formed of a higher density material than the endpiece.

2. The base pad of claim 1 wherein the at least one endpiece is formed of a low density material and the at least one crosspiece and covering are formed of medium to high density materials.

3. A base pad for supporting a product comprising:

two endpieces, each having portions for supporting the weight of the product;

two crosspieces;

means for connecting the endpieces and the crosspieces; and pliable covering pressed into place around each endpiece such that the covering deforms to the shape of each endpiece to minimize any deformation of the endpiece when supporting the product, said covering formed of a higher density material than the endpieces.

4. The base pad of claim 3 wherein the endpieces are formed of a low density material and the covering is formed of a medium to high density material.

5. The base pad of claim 4 wherein the crosspieces are formed of medium to high density material.

6. The base pad of claim 4 wherein the endpieces are formed of a material selected from the group consisting of resin based foams, expanded paper-based materials, honeycomb material, molded paper pulp materials, cork, bubble wrap, and recycled paper fibre.

7. The base pad of claim 6 wherein the crosspieces are formed material selected from the group consisting of paper, convolutely wound paperboard, recycled paper, treated paper, mixtures of paper and paperboard, and corrugated board.

8. The base pad of claim 4 wherein the endpieces are formed of resin based foam and the covering is formed of heavy paper.

9. The base pad of claim 8 wherein the crosspieces are formed of two or more layers of paper laminated together.

10. The base pad of claim 3 wherein each crosspiece comprises at least one tubular section having opposing ends and the connecting means comprises at least one projection extending from each endpiece which fits into an end of the at least one tubular section.

11. The base pad of claim 3 wherein each crosspiece comprises first and second tubular sections having opposing ends and a channel having opposing side walls and a bottom wall interposed between the tubular sections and running substantially the length of the crosspiece.

12. The base pad of claim 11 wherein the side walls are substantially parallel to each other.

13. The base pad of claim 11 wherein the connecting means comprises projections extending from each endpiece which fit into the ends of the crosspiece first and second tubular sections.

14. A base pad for supporting a product comprising:

two endpieces, each having portions for supporting the weight of the product and formed of a low density material;

two crosspieces formed of a medium to high density material;

means for connecting the endpieces and the crosspieces to form a substantially rectangular shaped pad; and pliable covering pressed into place around each endpiece such that the covering deforms to the shape of the endpiece to minimize any deformation of the endpiece when supporting the product, said covering formed of a higher density material than the endpieces, wherein the covering is glued to the endpieces to form a unitary structure.

15. The base pad of claim 14 wherein the endpieces are formed of expanded polystyrene, the crosspieces are formed of a plurality of layers of solid paper fiber laminated together, and the covering is formed of paper.

16. The base pad of claim 1 wherein the covering is glued to the at least one endpiece.

17. A base pad for supporting a product, comprising:

two endpieces, each having portions for supporting the weight of the product;

two crosspieces, each comprising at least one tubular section having opposing ends;

means for connecting the endpieces and the crosspieces, said connecting means comprising at least one projection extending from each endpiece which fits into an end of the at least one tubular section; and wrapping substantially covering the weight supporting portions of the endpieces for enhancing the strength thereof.

18. The base pad of claim 17 wherein the endpieces are formed of a low density material and the crosspieces and wrapping are formed of medium to high density material.

19. The base pad of claim 17 wherein the endpieces are formed of a material selected from the group consisting of resin based foams, expanded paper-based materials, honeycomb material, molded paper pulp materials, cork, bubble wrap, and recycled paper fibre.

20. The base pad of claim 19 wherein the wrapping is formed of a material selected from the group consisting of paper, paperboard and plastic wrap.

21. The base pad of claim 20 wherein the crosspieces are formed of a material selected from the group consisting of laminated paper, paperboard and corrugated board.

22. The base pad of claim 17 wherein the weight supporting portions comprise integrally formed raised platforms.

23. A base pad for supporting a product, comprising:

two endpieces, each having portions for supporting the weight of the product;

two crosspieces, each comprising first and second tubular sections having opposing ends and a groove interposed between the tubular sections and running substantially the length of the crosspiece;

means for connecting the endpieces and the crosspieces, said connecting means comprising projections extending from each endpiece which fit into the ends of the crosspiece first and second tubular sections; and wrapping substantially covering the weight supporting portions of the endpieces for enhancing the strength thereof.

24. The base pad of claim 23 wherein the endpieces are formed of a low density material and the crosspieces and wrapping are formed of medium to high density material.

25. The base pad of claim 23 wherein the endpieces are formed of a material selected from the group consisting of resin based foams, expanded paper-based materials, honeycomb material, molded paper pulp materials, cork, bubble wrap, and recycled paper fibre.

26. The base pad of claim 23 wherein the wrapping is formed of a material selected from the group consisting of paper, paperboard and plastic wrap.

27. The base pad of claim 23 wherein the crosspieces are formed of a material selected from the group consisting of laminated paper, paperboard and corrugated board.

28. The base pad of claim 23 wherein the weight supporting portions comprise integrally formed raised platforms.

* * * * *

UNITED STATES PATENT AND TRADEMARK OFFICE

CERTIFICATE OF CORRECTION

PATENT NO. : 6,155,527
DATED : December 5, 2000
INVENTOR(S) : Muyskens

It is certified that error appears in the above-identified patent and that said Letters Patent is hereby corrected as shown below:

Assignee address: Replace "NC" with -- SC --.

Signed and Sealed this

Twenty fifth Day of September, 2001

*Attest:*

Nicholas P. Godici

NICHOLAS P. GODICI
*Acting Director of the United States Patent and Trademark Office*

*Attesting Officer*